United States Patent [19]

Ashton et al.

[11] Patent Number: 4,830,682

[45] Date of Patent: May 16, 1989

[54] PROCESS FOR PRODUCING ALUMINUM-LITHIUM ALLOYS HAVING IMPROVED SUPERPLASTIC PROPERTIES

[75] Inventors: Richard F. Ashton; Bennie R. Ward, both of Richmond, Va.

[73] Assignee: Reynolds Metals Company, Richmond, Va.

[21] Appl. No.: 199,213

[22] Filed: May 25, 1988

[51] Int. Cl.[4] ..... C22F 1/04

[52] U.S. Cl. ..... 148/11.5 A; 148/12.7 A; 420/902

[58] Field of Search ..... 148/11.5 A, 12.7 A, 148/2; 420/902

[56] References Cited

U.S. PATENT DOCUMENTS 4,486,242 12/1984 Ward et al. ..... 148/11.5 A

*Primary Examiner*—R. Dean

*Attorney, Agent, or Firm*—Alan M. Biddison

[57] ABSTRACT

A process for improving the properties of an aluminum-lithium product formed from a slab, such as an ingot or billet, of an aluminum-lithium alloy. Improved properties include superplastic response, reduced edge cracking during rolling, and reduced formation of stains during annealing. The process includes heating the slab to an elevated temperature to solutionize its soluble constituents, holding the slab at the elevated temperature to allow its soluble constituents to go into solution, cooling the slab to a rolling initiation temperature above about 650° F. (343° C.), and hot/warm rolling the slab to a desired gauge.

16 Claims, No Drawings

PROCESS FOR PRODUCING ALUMINUM-LITHIUM ALLOYS HAVING IMPROVED SUPERPLASTIC PROPERTIES

BACKGROUND OF THE INVENTION

1. FIELD OF THE INVENTION

The invention relates to a method for processing aluminum alloys. More particularly, the invention provides a process for producing aluminum-lithium alloys having improved superplastic properties. The invention further provides an improved process for producing aluminum-lithium alloys that reduces edge cracking and the formation of a black film on the alloy being produced.

2. DESCRIPTION OF RELATED ART

Efforts to produce improved superplastic aluminum alloys, i.e., alloys of aluminum which can be superplastically formed using gas pressure or vacuum have been numerous and extensive as evidenced by the plethora of prior art describing such materials and methods for their preparation.

One of the prior art techniques is described in U.S. Pat. No. 3,847,681 issued Nov. 12, 1974, to Waldman et al. This technique involves the steps of:

a. solution heat treating the starting material for 4–48 hours at a temperature greater than 860° F.;

b. slow cooling the product of step (a) to an overage temperature, i.e., about 775° F.;

c. overage at about 775° F. for 3 to 6 hours;

d. slow cooling the product of step (c) to a temperature of between about 450° -500° F. and optionally holding at this temperature for up to 4 hours;

e. plastically deforming the material (from 40–80%) at a temperature between about 450° and 500° F.;

f. rapidly recrystallizing at a temperature of between about 800° and 900° F.

This process reportedly provides a fine grain structured Aluminum Association ("AA") 7000 series alloy.

A second prior art process is described in U.S. Pat. No. 4,092,181 issued May30, 1978 to Paton et al. This patent describes a process for preparing material reportedly of finer grain than that described in U.S. Pat. No. 3,847,681, according to a somewhat shorter procedure, and with heat treatable alloys other than those of U.S. Pat. No. 3,847,681. The additional alloys may include chromium as an alloying element.

The process of U.S. Pat. No. 4,092,181 is quite similar to that of U.S. Pat. No. 3,847,681, except that it offers the option of cold water quenching after solution heat treat and before overage (i.e., between steps (a) and (c) of U.S. Pat. No. 3,847,681) and eliminates the need for the optional soaking or holding of step (d) of U.S. Pat. No. 3,847,681.

A third prior art technique is described in Ward et al's U.S. Pat. No. 4,486,242 issued Dec. 4, 1984 and U.S. Pat. No. 4,528,042 issued July 9, 1985. The technique described in these patents is intended for continuous processing of heat-treatable alloys, particularly those of the 2000 and 7000 series. The alloy being treated according to this process is solution heat treated, cooled to a temperature between about 600° and 700° F. (316° and 371° C.), hot/warm rolled to an intermediate gauge, warm or cold rolled to a final gauge, and subjected to a rapid recrystallization treatment.

The contents of U.S. Pat. Nos. 3,847,681, 4,092,181, 4,486,242, and 4,528,042 are incorporated herein by reference.

The present invention differs from the third prior art technique in several important aspects. The invention starts with an aluminum-lithium alloy that has been homogenized, heat treated, cooled, and subjected to initial rolling. This alloy, when processed according to the present invention, is then reheated to a temperature of about 1000° F. (538° C.) and is held at this temperature for a period of time sufficiently long to redissolve most of the soluble components, for instance, about an hour or longer. The hot/warm rolling step is started at a temperature greater than about 700° F. (371° C.) when the alloy will be subjected to further rolling after hot/-warm rolling. Hot/warm rolling can start as low as about 650° F. (343° C.) when further rolling after the hot line gauge is not required. In addition, the process provided by the invention does not require a separate final recrystallization step after rolling to final gauge because aluminum-lithium alloys dynamically recrystallize during subsequent hot forming operations. The prior art practices require additional processing after rolling to obtain static recrystallization.

Additional prior art techniques for producing superplastic aluminum sheet are described in "The Manufacture of Superplastic Alloys," by Dr. R. Grimes, a publication supporting Lecture Series No. 154 ("Superplasticity") under the sponsorship of the Structures and Materials Panel and the Consultant and Exchange Programme of the Advisory Group for Aerospace Research and Development of the North Atlantic Treaty Organization. The Lecture Series was presented on Sept. 8 and 9, 1987 at Wright-Patterson AFB. The contents of this publication are incorporated herein by reference.

SUMMARY OF THE INVENTION

The present invention provides a process for improving the properties of an aluminum-lithium product formed from a slab, such as an ingot or billet, of an aluminum-lithium alloy. Improved properties include super-plastic response, reduced edge cracking during rolling, and reduced formation of stains during annealing. The process includes heating the slab to an elevated temperature to solutionize its soluble constituents, holding the slab at the elevated temperature to allow its soluble constituents to go into solution, cooling the slab to a rolling initiation temperature above about 650° F. (343° C.), and hot/warm rolling the slab to a desired gauge.

One feature of the invention provides a method for producing superplastic aluminum-lithium sheet, which method is readily practiced in a plant environment. This method is applicable to heat-treatable alloys, such as AA2090, AA2091, AA8090, and AA8091. When aluminum-lithium plate and sheet have been processed according to the present invention, very large amounts of plastic deformation from 50 percent to several hundred percent can be obtained to produce complex parts which would normally be produced by joining several parts formed by conventional processes.

Another feature of the invention consists of a process for producing aluminum-lithium plate and sheet that minimizes the problem of black stains that is encountered during annealing of aluminum-lithium plate and sheet. The film is formed on the surface of the metal during processing.

Still another feature of the present invention is the reduction of metal losses during rolling because of reduced edge cracking. Metal processed in accordance with the present invention has surprisingly less edge cracking during rolling than encountered when using conventional rolling practices.

Yet another feature of the present invention is the provision of sheet material that can be superplastically deformed at higher rates than are possible with conventional AA7000 series alloys, such as AA7475.

The invention provides a thermomechanical process for producing aluminum-lithium alloys having improved superplastic properties. One embodiment of the process provided by the present invention starts with a scalped DC cast ingot that has been cooled to ambient temperature after being homogenized.

The inventive process includes the following steps:

a. heating the ingot to an elevated temperature around 1000° F. (538° C.);

b. holding the ingot at the elevated temperature for at least 30 minutes;

c. cooling the ingot to a rolling initiation temperature above 700° F. (371° C.); and d. hot/warm rolling the ingot to a desired gauge.

Variants of the preceding process include cross rolling the ingot to an intermediate gauge prior to step a, cold or warm rolling the metal of step d to a final gauge, and reheating the metal as necessary during step d to maintain the temperature above a minimum level.

Use of the preceding process also reduces edge cracking during rolling and reduces or eliminates the formation of black stains during processing.

The invention, and its objects and advantages, will become more apparent in the detailed description of the preferred embodiments hereinafter presented.

DESCRIPTION OF THE PREFERRED EMBODIMENTS

Because processes for producing aluminum sheet and plate are well known, the present description will be directed in particular to elements constituting the invention. Elements not specifically described can be selected from those known in the art.

Considering the invention in more detail, one embodiment of the present invention includes the following process steps:

a. homogenizing a DC cast aluminum-lithium ingot at a temperature preferably above 950° F. (510° C.), for instance approximately 1010° F. (543° C.), for about 15 to 24 hours;

b. cooling the homogenized ingot to ambient and scalping the ingot to remove oxide inclusions and other surface impurities;

c. heating the scalped ingot to an appropriate temperature, such as 850°–875° F. (454°–468° C.), and cross rolling the scalped ingot to reduce anisotropy thereby providing plate having a first intermediate gauge;

d. cooling the first intermediate gauge plate to ambient;

e. heating the first intermediate gauge plate to an elevated temperature of approximately 1,010° F. (543° C.) and holding such plate at the elevated temperature for an appropriate time period, such as two hours;

f. cooling such plate at a controlled rate, such as 50° F. (28° C.) per hour, to a desired temperature for starting hot rolling, for example approximately 800°–850° F. (427°–454° C.);

g. hot/warm rolling such plate to a second intermediate gauge, for instance 0.130 inches (0.33 cm); and h. cold rolling the second intermediate gauge plate to a final gauge, such as 0.060 inches (0.15 cm).

Several comments about the proceeding are appropriate.

The starting material processed by the present invention is not limited to a particular type or form of metal. For example, the invention can be used to process ingot or thin billet. The ingot can be DC cast, electromagnetic cast, or cast in any suitable manner. The ingot, depending on its surface characteristics, might or might not be scalped. The material processed by the invention, for the purposes of convenience, will be referred to as slab. It is to be understood that the term "slab" is not intended to limit the material being processed to a particular form or type.

The term "hot rolling" is a relative term. It means rolling the metal above its recrystallization temperature so that the strain energy is continuously removed. Alloy composition determines the temperature range for hot rolling. Generally, hot rolling requires maintaining a temperature above 650° F. (343° C.).

The term "cold rolling" also is a relative term. It means rolling the metal at a temperature at which all of the energy is retained by the metal. Alloy composition determines the temperature range for cold rolling. Normally cold rolling is rolling at ambient temperature.

The term "warm rolling" means rolling at a temperature below the hot rolling temperature and above the cold rolling temperature. When rolling occurs at this temperature some of the stress in the metal created by rolling is relieved. Generally, a temperature above 550° F. (288° C.) should be maintained to avoid the effects of cold rolling.

Cross rolling (step c) is especially important when producing plate gauges (gauges of at least 0.250 inches—0.635 cm). Cross rolling is not as important when producing sheet gauges because of the increased amount of rolling in the longitudinal direction during the production of sheet gauges.

Step d can be eliminated. The alloy, after being cross rolled, can be heated to the elevated temperature of step e. Production scheduling considerations usually dictate the inclusion of step d in the process.

Holding the metal at 1010° F. (543° C.) (step e) apparently results in depleting lithium from the surface of the plate. This surface depletion provides a benefit in that a black lithium-containing film is not fomed on the surface of the metal during subsequent processing, such as rolling and annealing to obtain a desired product. Removal of the film from conventionally processed aluminum-lithium alloys can be burdensome.

The temperature range for the elevated temperature of step e is a function of the alloy being processed. The minimum temperature for step e is the temperature at which substantially all of the alloying constituents are in solution. The maximum temperature is that at which melting of the alloy starts. The temperature range for processing AA2090 would be from approximately 980° (527° C.) to approximately 1010° F. (543° C.), with approximately 1000° F. (538° C.) being a desired temperature. The temperature range for AA8090 would be from approximately 1000° F. (538° C.) to approximately 1030° F. (554° C.), with approximately 1020° F. (549° C.) being a desired temperature.

The holding time specified in step e must be sufficiently long to allow for substantially all of the soluble alloying constituents to go into solution. The time is a function of the method used to heat the metal. When conventional gas heated furnaces are used, the holding time should be between 1 and about 6 to 8 hours, with a holding time of about 2 hours being preferred.

The rate of cooling for step f is a function of factors such as the method used to cool the plate and the size of the material being cooled. When the material is furnace cooled, the minimum cooling rate is around 20° F. (11° C.) per hour and the maximum rate is around 100° F. (56° C.) per hour. A desired rate is in the range of 40°-50° F. (22-28° C.) per hour. The rate also can influence the rolling initiation temperature.

The range for the rolling initiation temperature of step f is a function of factors such as the alloy being processed and the desired final gauge of the product. A temperature as low as 650° F. (343° C.) is possible if the desired final gauge is the gauge produced by hot/warm rolling (step g). If the alloy is to be subjected to further rolling after step g, a temperature above 700° F. (371° C.) is desired. Material that was hot/warm rolled at a starting temperature of 675° F. (357° C.) did not have adequate superplastic properties when subsequently cold rolled to a lower gauge.

It should be appreciated that the temperatures specified in the different steps are approximate temperatures. It is extremely difficult to heat or cool a large ingot or thick sheet to a uniform temperature. In practice, several thermocouples are attached to the material being heated and the holding time is started when the coldest measured temperature is within 20° F. (11° C.) of the desired temperature. Preferably, when the metal is cooled to a desired temperature, such as in step f, the metal is held at the temperature to allow thermal stabilization prior to subsequent processing.

During hot/warm rolling (step g) the temperature of the metal should be maintained above 550° F. (288° C.) to avoid the effects of cold rolling. The capacity of the mill and the desired amount of reduction determine whether or not the metal must be reheated to maintain the desired hot/warm rolling temperature range. A preferred reheat practice is to reheat the metal to about 750° F. (399° C.) and resume hot/warm rolling. There is no need to hold the metal at the reheated temperature prior to resuming rolling.

The maximum desired temperature for step f is a function of the alloy being processed. If hot rolling is started at too high a temperature, there may be problems with hot-shortness or cracking during hot rolling. A maximum desired temperature of around 950° F. (510° C.) can be used, with a desired temperature of around 800° F. (427° C.) being preferred.

Also, the superplastic properties of the metal may be reduced if rolling is started at too high a temperature. For instance, one sample of metal rolled at a starting temperature of 950° F. (510° C.), when subjected to a strain rate of $6\times10^{-4}$ sec at 932° F. (500° C.), experienced 259% elongation. Another sample of the same metal, when rolled at a starting temperature of 800° F. (427° C.) and subjected to the same test, experienced 860% elongation.

As previously mentioned, the gauge produced by step g can be the desired final gauge. Alternatively, the final gauge can be a thinner gauge obtained by warm rolling, by cold rolling, or by warm and cold rolling. There is no need to subject the material produced by either step g or step h to further processing to develop superplastic properties.

Steps e, f, and g are the critical steps of the process provided by the present invention for providing aluminum-lithium alloys having improved superplastic properties. One variant of these superplastic processing steps is as follows: step e—heatig an aluminum-lithium plate at a rate of 80° F. (27° C.) per hour to 1,000° F. (538° C.) and holding the plate at such temperature for two hours; step f'—cooling the plate at a rate of 50° F. (28° C.) per hour to 800° F. (427° C.); and step g'—hot/-warm rolling the plate until an exit mill temperature of about 565° F. (296° C.) is reached, reheating the plate to 740° F. (393° C.), and hot/warm rolling the plate to a desired gauge. Plate produced according to the modified process had enhanced superplastic properties, rolled easily, and had no visible signs of edge cracking.

The process provided by the present invention eliminates the need for the recrystallization step described in U.S. Pat. Nos. 4,486,242, 4,486,244, and 4,528,042.

EXAMPLE 1

A series of tests demonstrated the superior rolling results obtainable with the present invention when processing AA8090 (2.32 wt % Li, 1.3 Cu, 0.8 Mg, 0.016 Ti, 0.13 Zr, balance aluminum) plate. A 1.0 inch (2.54 cm) plate was hot rolled to 0.190 inches (0.48 cm), without reheats, using the following practices;

A. heat from ambient to 950° F. (510° C.), roll to gauge;

B. heat from ambient to 850° F. (454° C.), roll to gauge;

C. heat from ambient to 750° F. (399° C.), roll to gauge;

D., E., and F. heat to 1,000° F. (538° C.); hold for two hours; cool at 50° F. (28° C.) per hour to 950° F. (510° C.) for D, to 850° F. (454° C.) for E, to 750° F. (399° C.) for F; and roll to gauge.

Cold rolling followed, either without or with a prior anneal (hold at 775° F. (411° C.) for two hours, with a heating and cooling rate of 50° F. (28° C.) per hour).

EDGE CRACKING
WHEN COLD ROLLED TO 0.130 INCHES (0.33 CM)

| Sample | No Anneal | Anneal |
|---|---|---|
| A | severe | moderate |
| B | severe | moderate |
| C | slight | none |
| D | very slight | none |
| E | very sight | none |
| F | extremely slight | none |

Samples A, B, and C, which were rolled without being held at an elevated temperature, showed noticeably more edge cracking than encountered with Samples D, E, and F, samples which were processed in accordance with the present invention.

EXAMPLE 2

Another example according to the present invention follows. An AA2090 alloy (0.03 wt % Si, 0.06 Fe, 2.51 Cu, 0.02 Zn, 0.02 Ti, 2.13 Li, 0.13 Zr, less than 0.001 Na, balance aluminum) was processed in this example. A 16 inch by 54 inch by 106 inch ingot (40×137×269 cm) was homogenized at approximately 850° F. (454° C.) for four hours, heated at a rate of 15° F. (8° C.) per hour to slightly over 1,000° F. (538° C.) and held for twenty hours. The ingot then was air cooled and scalped. The scalped ingot was heated to a temperature above 900° F. (482° C.), held for 8.5 hours, cross rolled at an entry temperature of less than 800° F. (427° C.), and straight rolled at a temperature above 700° F. (371° C.). The metal was then air cooled to ambient.

The air cooled metal was subjected to superplastic processing according to the present invention. More particularly, the metal was heated at a rate of approximately 80° F. (44° C.) per hour to 1,000° F. (538° C.) and held for two hours. It then was cooled at a rate of 50° F. (28° C.) per hour to 800° F. (427° C.), hot/warm rolled, reheated after it reached 565° F. (296° C.) to 740° F. (393° C.), and hot/warm to 0.191 inches (0.485 cm). The sample was cold rolled to either 0.130 inches (0.33 cm) or 0.090 inches (0.22 cm), either with an anneal similar to that previously described prior to cold rolling or without an anneal.

A base line sample of the same composition was conventionally processed to a hot line gauge of 0.216 inches (0.55 cm) and cold rolled to 0.130 inches (0.33 cm). This material, when uniaxially tested at 932° F. (500° C.) with no cavitation suppression, had the following response:

| | Strain Rate ($sec^{-1}$) | Percent Elongation |
|---|---|---|
| Hot Line | $3 \times 10^{-4}$ | 415% |
| (0.216") | $6 \times 10^{-4}$ | 301% |
| Cold Rolled | $3 \times 10^{-4}$ | 287% |
| (0.130") | $6 \times 10^{-4}$ | 274% |

In comparison, the samples processed in accordance with the invention had the following superplastic responses when tested under the same conditions:

| Strain Rate ($sec^{-1}$) | Hot Line (0.191") | 0.130" no anneal | 0.130" anneal | 0.090" no anneal | 0.090" anneal |
|---|---|---|---|---|---|
| $3 \times 10^{-4}$ | 569% | 544% | 377% | 489% | 592% |
| $6 \times 10^{-4}$ | 571% | 471% | 307% | 399% | 527% |

Clearly, the samples processed in accordance with the present invention had superplastic properties that were superior to the properties of the base line material.

EXAMPLE 3

Another example according to the present invention follows. An AA2090 alloy (0.02 wt % Si, 0.02 Fe, 2.42 Cu, 0.02 Zn, 0.02 Ti, 2.17 Li, 0.15 Zr, balance aluminum) was processed in this example. A 3×9×16 in. (7.62×22.86×40.64 cm.) scalped slab from a homogenized lab cast ingot was preheated to 870° F. (466° C.) and cross rolled to 1.425 in. (3.6 cm.) thick. After cooling to ambient temperature, a 5 ft. (152.4 cm.) wide section of this metal was heated to 1010° F. (543° C.) and held at this temperature for 1½hr. The metal then was cooled at a rate of 50° F. (28° C.) per hour to 800° F. (427° C.) and hot/warm rolled to 0.130 in. (0.33 cm.), with reheats to 750° F. (397° C.) at 0.5 in. (1.27 cm.) and 0.25 in. (0.63 cm.) when temperatures reached 550° F. (288° C.).

The metal was then tested for superplastic response (percent elongation before failure) at 932° F. (500° C.) in the following conditions: (A) at hot line gauge of 0.130 in. (0.33 cm.), (B) warm rolled starting at 550° F. (288° C.), to 0.090 in. (0.23 cm.), (C) cold rolled to 0.090 in. (0.23 cm.), (D) cold rolled to 0.060 in. (0.15 cm.).

| SUPERPLASTIC RESPONSE | STRAIN RATE ($SEC^{-1}$) | |
|---|---|---|
| | $3 \times 10^{-4}$ | $6 \times 10^{-4}$ |
| A-hot line gauge | 1037% | 932% |
| B-warm rolled gauge | 834% | 862% |
| C-cold rolled gauge | 933% | 777% |
| D-cold rolled gauge | 835% | 860% |

This example clearly demonstrates that the invention provides a process for producing aluminum-lithium alloys having excellent superplastic properties. The properties exist at the hot line gauge, after warm rolling to gauge, and after cold rolling to gauge. No processing after rolling is required to develop the superplastic properties.

EXAMPLE 4

With this example, samples of metal were processed in accordance with Example 3. With this example, however, the starting temperatures for hot/warm rolling were varied. Starting temperatures used were 650° F. (343° C.), 750° F. (399° C.), 850° F. (454° C.), 900° F. (482° C.) and 950° F. (510° C.). The following results were obtained when the samples were tested in the manner and for the conditions specified for Example 3:

| SUPERPLASTIC RESPONSE | 650° F. | 750° F. | 850° F. | 900° F. | 950° F. |
|---|---|---|---|---|---|
| STRAIN RATE $3 \times 10^{-4}$ SEC | | | | | |
| A | 1130% | 1047% | 1006% | 671% | 458% |
| B | 503% | 1064% | 448% | 487% | 666% |
| C | 252% | 609% | 809% | 440% | 528% |
| D | 498% | 460% | 598% | 776% | 207% |
| STRAIN RATE $6 \times 10^{-4}$ SEC | | | | | |
| A | 720% | 994% | 629% | 386% | 426% |
| B | 263% | 711% | 516% | 553% | 419% |
| C | 242% | 665% | 458% | 324% | 613% |
| D | 350% | 414% | 603% | 589% | 259% |

Evaluation of information set forth in Examples 3 and 4 establishes the surprising results obtainable when samples of metal are processed in accordance with the present invention. Superplastic response generally increases as the starting temperatures for hot/warm rolling increase from 650° F. (343° C.) to 800° F. (427° C.). Superplastic response generally decreases as the starting temperatures for hot/warm rolling increase from 800° F. (427° C.) to 950° F. (510° C.). A starting temperature between about 750° F. (399° C.) and about 850° F. (454° C.) appears to provide best results, with a starting temperature of around 800° F. (427° C.) being preferred. Both strain rates used to test superplastic response provided acceptable results.

EXAMPLE 5

In this example, first and second samples of AA8090 alloy were heated at a rate of 100° F. (56° C.) per hour to 1000° F. (538° C.) and held at this temperature for two hours. The samples then were cooled at a rate of 50° F. (28° C.) to rolling initiation temperatures (850° F. (454° C.) for the first samples and 750° F. (399° C.) for the second samples). The samples then were hot/warm rolled to desired gauges. Third samples of the same metal were heated to 850° F. (454° C.) and hot/warm rolled to desired gauges. Fourth samples of the same metal were heated to 750° F. and hot/warm rolled to desired gauges. Some of the samples were then annealed at the hot line gauge for 6 hours at 775° F. (413° C.). Heat up and cool down rates of 75° F. (42° C.) were used. Others of the samples were not annealed. All of the samples were then cold rolled either 25%, 50% or 75%.

Examination of the samples indicated that the first samples that also were annealed evidenced the least amount of edge cracking during cold rolling. All of the third and fourth samples stained black during the hot line gauge anneal, while none of the first or second samples stained. This example clearly demonstrates that the thermal practice provided by the present invention both reduces staining during annealing and reduces edge cracking during rolling.

Previously, specific embodiments of the present invention have been described. It should be appreciated, however, that these embodiments have been described for the purposes of illustration only, without any intention of limiting the scope of the invention. Rather, it is the intention that the invention be limited only by the appended claims.

We claim:

1. A process for improving the superplastic properties of a slab of an aluminum-lithium alloy comprising:

a. heating the slab to an elevated temperature to solutionize its soluble alloying constituents;

b. holding the slab at the elevated temperature sufficiently long to allow for substantially all of the soluble alloying constituents to go into solution;

c. cooling the slab at a controlled rate from the elevated temperature to a rolling initiation temperature above 700° F. (371° C.) prior to commencing rolling; and d. hot/warm rolling the cooled slab to a desired gauge.

2. The process of claim 1, wherein the elevated temperature of step a is greater than about 980° F. (527° C.).

3. The process of claim 1, further comprising holding the slab at the elevated temperature for at least one hour.

4. The process of claim 1, wherein the rolling initiation temperature of step c is above 750° F. (399° C.).

5. The process of claim 1, wherein the rolling initiation temperature of step c is between about 750° F. (399° C.) and about 850° F. (454° C.).

6. The process of claim 1, wherein the rolling initiation temperature of step c is about 800° F. (427° C.).

7. The process of claim 1, further comprising reheating the metal during hot/warm rolling so as to maintain its temperature above about 550° F. (288° C.).

8. The process of claim 8, wherein the metal is reheated to about 750° F. (399° C.).

9. A process for producing an aluminum-lithium alloy product having improved superplastic properties comprising:

a. heating the slab to an elevated temperature to solutionize its soluble alloying constituents;

b. holding the slab at the elevated temperature sufficiently long to allow for substantially all of the soluble alloying constituents to go into solution;

c. cooling the slab at a controlled rate from the elevated temperature to a rolling initiation temperature above 650° F. (343° C.) prior to commencing rolling; and d. hot/warm rolling the cooled slab to a desired gauge thereby obtaining the product having the improved superplastic properties.

10. A process for reducing edge cracking during processing of a slab of an aluminum-lithium alloy comprising:

a. heating the slab to an elevated temperature to solutionize its soluble alloying constituents;

b. holding the slab at the elevated temperature sufficiently long to allow for substantially all of the soluble alloying constituents to go into solution;

c. cooling the slab from the elevated temperature to a temperature above 700° F. (371° C.) prior to commencing rolling; and d. hot/warm rolling the cooled slab to a desired gauge.

11. A process for reducing formation of black stains during annealing of an aluminum-lithium alloy comprising:

a. heating a slab of an aluminum-lithium alloy to an elevated temperature greater than about 980° F. (527° C.);

b. holding the slab at the elevated temperature for at least one hour;

c. cooling the slab at a controlled rate to a rolling initiation temperature and d. rollinq and annealing the slab to obtain a desired product.

12. A process for treating a slab of an aluminum-lithium alloy comprising:

a. heating the slab to an elevated temperature above about 980° F. (527° C.) to solutionize its soluble alloying constituents;

b. holding the slab at the elevated temperature for at least about an hour to allow for substantially all of its soluble alloying constituents to go into solution;

c. cooling the slab at a controlled rate from the elevated temperature to a rolling initiation temperature between about 650° F. (343° C.) and about 950° F. (510° C.);

d. hot/warm rolling the cooled slab to a desired gauge.

13. The process of claim 12, further comprising maintaining the temperature of the slab during hot/warm rolling above about 550° F. (288° C.) by reheating the slab during hot/warm rolling.

14. The process of claim 12, further comprising rolling the product produced by step d to a final gauge.

15. The process of claim 12, wherein the rolling initiation temperature of step c is between about 750° F. (399° C.) and about 850° F. (454° C.).

16. The process of claim 12, wherein the rolling initiation temperature of step c is above 700° F. (371° C.).

* * * * *